US008152039B2

(12) United States Patent
Searle et al.

(10) Patent No.: US 8,152,039 B2
(45) **Date of Patent: *Apr. 10, 2012**

(54) RECESS FILLING APPARATUS

(75) Inventors: Roy Searle, Worcester (GB); Jan Holland, Birmingham (GB)

(73) Assignee: Nail Seal Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/102,810

(22) Filed: May 6, 2011

(65) Prior Publication Data

US 2011/0259474 A1 Oct. 27, 2011

Related U.S. Application Data

(63) Continuation of application No. 12/341,968, filed on Dec. 22, 2008, now Pat. No. 7,963,428.

(30) Foreign Application Priority Data

Jan. 29, 2008 (GB) ..... 0801563.8
Nov. 7, 2008 (GB) ..... 0820409.1

(51) Int. Cl.
*B25B 23/04* (2006.01)

(52) U.S. Cl. ..... 227/18; 227/16; 206/343

(58) Field of Classification Search ..... 206/343, 206/346, 338, 348, 713, 714, 725, 820; 227/120, 227/15–18, 31, 99, 119, 136, 147
See application file for complete search history.

(56) References Cited

U.S. PATENT DOCUMENTS 5,855,151 A * 1/1999 Habermehl ..... 81/434
7,963,428 B2 * 6/2011 Searle et al. ..... 227/18

* cited by examiner

*Primary Examiner* — J. Gregory Pickett
*Assistant Examiner* — Raven Collins
(74) *Attorney, Agent, or Firm* — Tumey L.L.P.

(57) ABSTRACT

A recess filling apparatus forms part of, or is for use with, a tool for driving a multiplicity of fixing elements into a work surface. The apparatus utilizes a dispensing strip defining a multiplicity of chambers containing filler material, each chamber containing sufficient filler material for use with a single fixing element. The apparatus comprises means to support the dispensing strip, and means for locating a chamber that contains filler material in or adjacent to the path of a fixing element, and for advancing the dispensing strip prior to driving the next fixing element.

9 Claims, 11 Drawing Sheets a
b
c
90
91
92
93
94
95
96
97
88
R
T
Q
100
101
104
110
112
113
114
116
118
120
122
124
126

RECESS FILLING APPARATUS

This application is a continuation of U.S. patent application Ser. No. 12/341,968, entitled "Recess Filling Apparatus," filed on Dec. 22, 2008, the entire disclosure of which is incorporated herein by reference. U.K. Application No. 0801563.8 filed Jan. 29, 2008 and U.K. Application No. 0820409.1 filed Nov. 7, 2008 are also hereby incorporated by reference in their entirety.

The present invention relates to a recess filling apparatus which forms part of a tool for driving a multiplicity of fixing elements into a work surface, for example of constructional material, or which is used with such a tool. The invention also relates to a way of providing filling material for use with the recess filling apparatus.

The tool may, for example, be one used for driving fixing elements such as nails or screws into a material such as wood, or to attach a material such as plasterboard to an underlying structure for example of wood. For example it may be a nail gun such as may be used in the construction of wooden structures such as pallets and crates, fixing floor boards, manufacturing furniture, and attaching wooden trim to windows and doorframes. When using such a tool, each fixing element may be driven in to such a depth that a shallow depression is left above it. To improve the final finish the resulting depression may be filled with a suitable filling material, depending on the nature of the material in which the depression is formed. This may be done manually, after use of the tool, but it would be more convenient if this could be carried out automatically as the tool is being used.

According to the present invention there is provided a recess filling apparatus forming part of, or for use with, a tool for driving a multiplicity of fixing elements into a workpiece, the apparatus utilising a dispensing strip defining a multiplicity of chambers containing filler material, each chamber containing sufficient filler material for use with a single fixing element, and the apparatus comprising means to support the dispensing strip, and means for locating a chamber that contains filler material in or adjacent to the path of a fixing element, and for advancing the dispensing strip prior to driving the next fixing element.

The present invention also provides a recess filling apparatus suitable for filling recesses produced by driving a fixing element into a workpiece, the apparatus utilising a dispensing strip defining a multiplicity of chambers containing filler material, each chamber containing sufficient filler material for use with a single such recess, and the apparatus comprising means to support the dispensing strip, and means for locating a chamber that contains filler material adjacent to such a recess and for dispensing at least part of the filler material in the chamber into the recess, and then for advancing the dispensing strip prior to filling the next recess.

The present invention also provides a dispensing strip for use with the recess filling apparatus.

The dispensing strip may comprise support projections such that a gap is defined between the base of each chamber and the surface of the workpiece, in use. Preferably the support projections are continuous ribs, so reducing the risk of splatter of the filler material as each fixing element is driven in, and preferably the support projections are resilient. Alternatively the underside of each chamber may rest directly on the surface, so there is no gap. Where the underside of each chamber rests on the surface, the movement of the dispensing strip when the strip is advanced may smooth the filler in the recess.

Preferably the dispensing strip defines a wiper element for each chamber, arranged so that after filler material has been introduced into a recess the wiper element moves over the surface of the filler material. This may provide a smoother resulting finish. The wiper element may project from the dispensing strip in its initial state, or may be formed by part of the base of the dispensing strip, for example by part of the base of the chamber after the fixing element has been driven in. The movement of the wiper element may arise from resilience of the wiper element itself, or may be brought about by movement of the dispensing strip as it is advanced into a new position.

If the wiper element is inclined to the surface of the workpiece, the wiper element may move over the surface such that the edge of the wiper element in contact with the surface is the trailing edge of the wiper element. Alternatively the edge of the wiper element in contact with the surface may be the leading edge. In the latter case any excess filler material is picked up onto the surface of the wiper element remote from the workpiece, and so removed.

In one embodiment the dispensing strip defines chambers each of which extends substantially the width of the strip, so that after passing the dispensing strip through the apparatus the filler material from all the chambers has been used up, and the dispensing strip is then finished with. Alternatively, each of the chambers of the dispensing strip extends only over a fraction of the width of the strip, so the strip defines a plurality of side by side rows of chambers. In the latter case after passing the dispensing strip once through the apparatus only the chambers of one row have been used up; the dispensing strip can then be fed through the apparatus again, to use up the chambers of another row. For example there may be two rows of chambers, each chamber extending only over about half the width of the strip.

The invention will now be further and more particularly described, by way of example only, and with reference to the accompanying drawings in which.

Figures 9, 10, 11, 12:
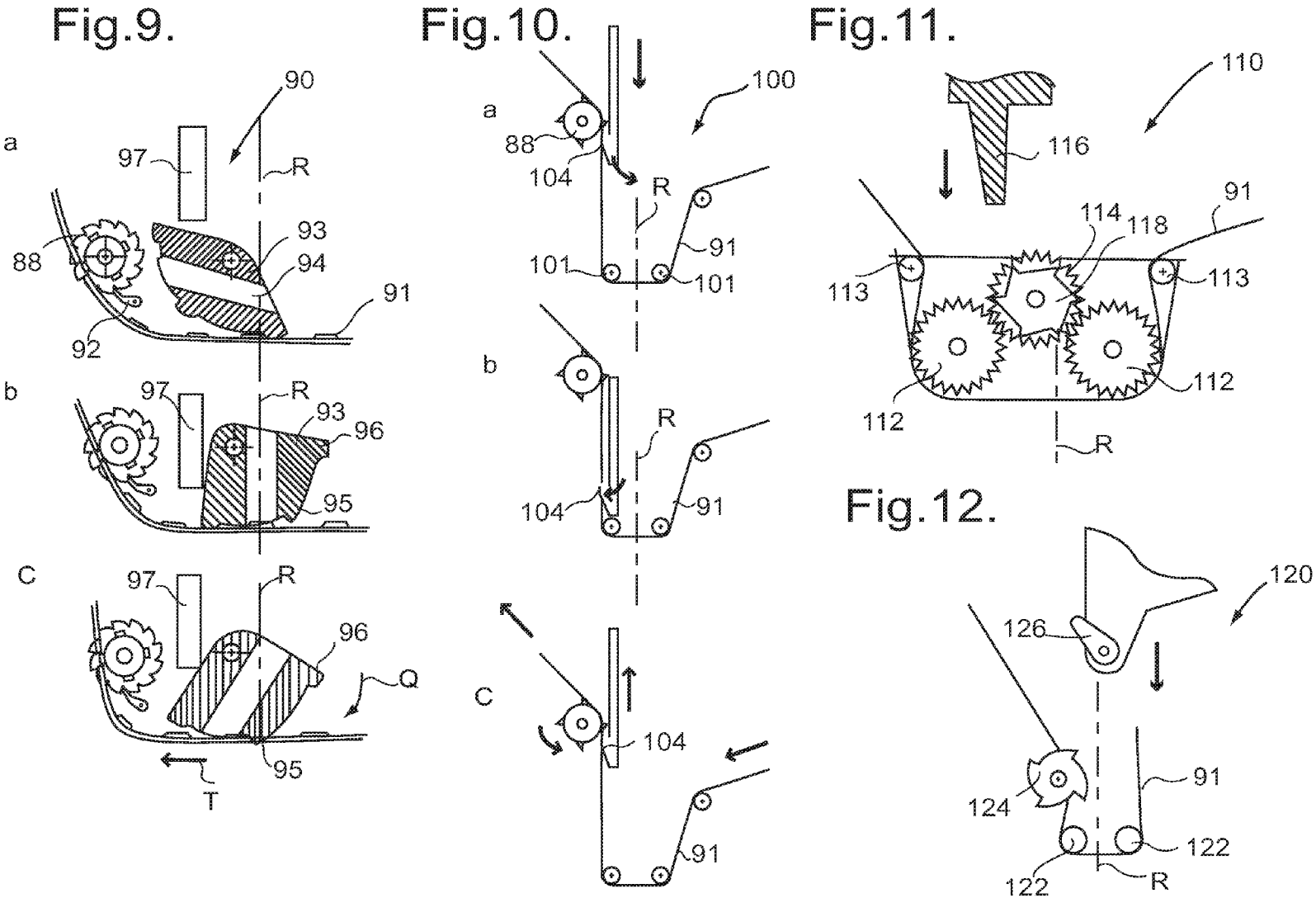
Figure 13:
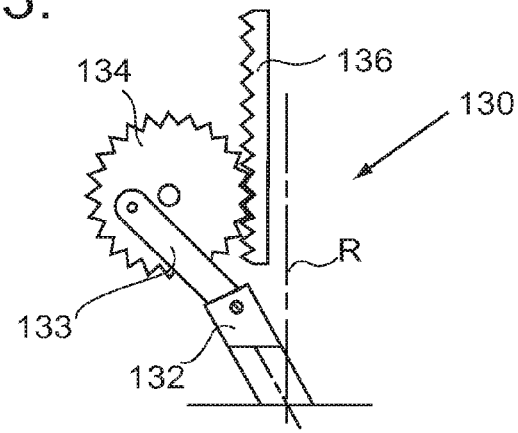
Figure 14A:
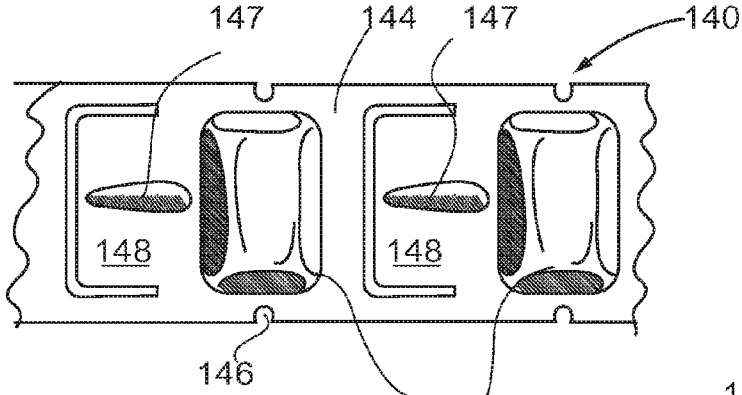
Figure 14B:
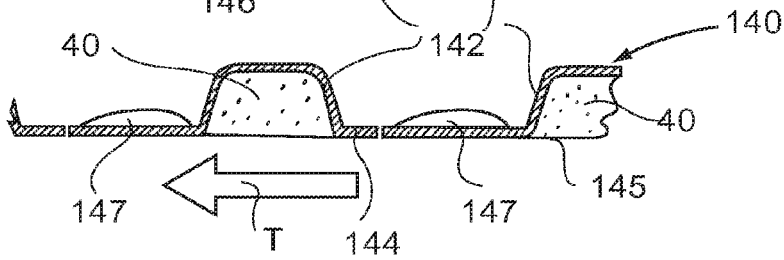
Figure 15:
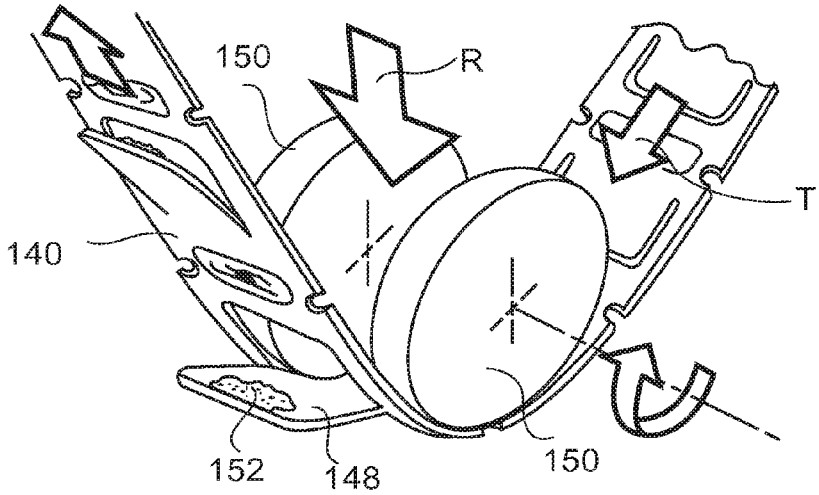

FIGS. 9*a* to 9*c* show schematic sectional views of successive positions of a mechanism for advancing a dispensing strip;

FIGS. 10*a* to 10*c* show schematic side views of successive positions of an alternative mechanism for advancing a dispensing strip;

FIG. 11 shows a schematic side view of another alternative mechanism for advancing a dispensing strip;

FIG. 12 shows a schematic side view of another alternative mechanism for advancing a dispensing strip;

FIG. 13 shows a schematic side view of a mechanism for compressing filler from a dispensing strip;

FIGS. 14*a* and 14*b* show a plan view and a longitudinal sectional view of an alternative dispensing strip;

FIG. 15 shows a perspective view of part of a mechanism using the dispensing strip of FIGS. 14*a* and 14*b;*

Figure 16:
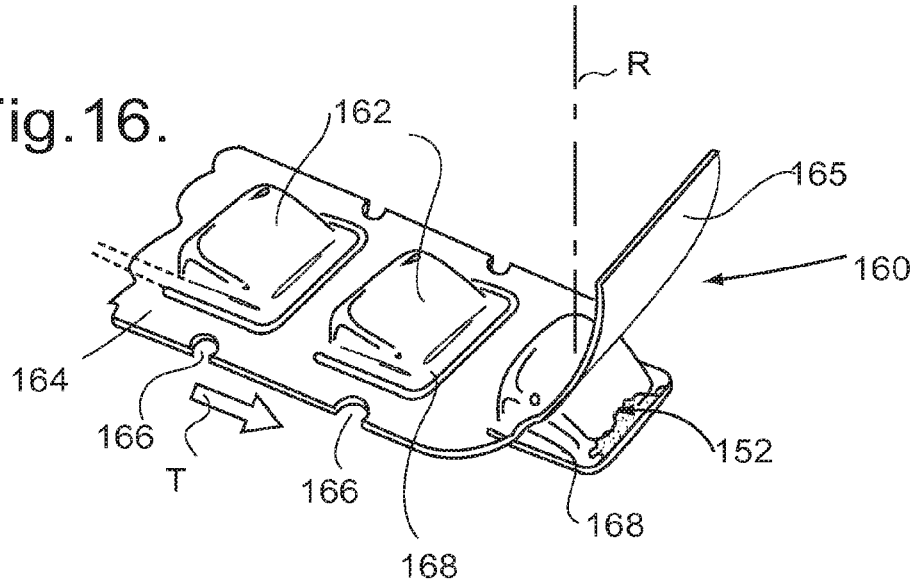
Figure 17:
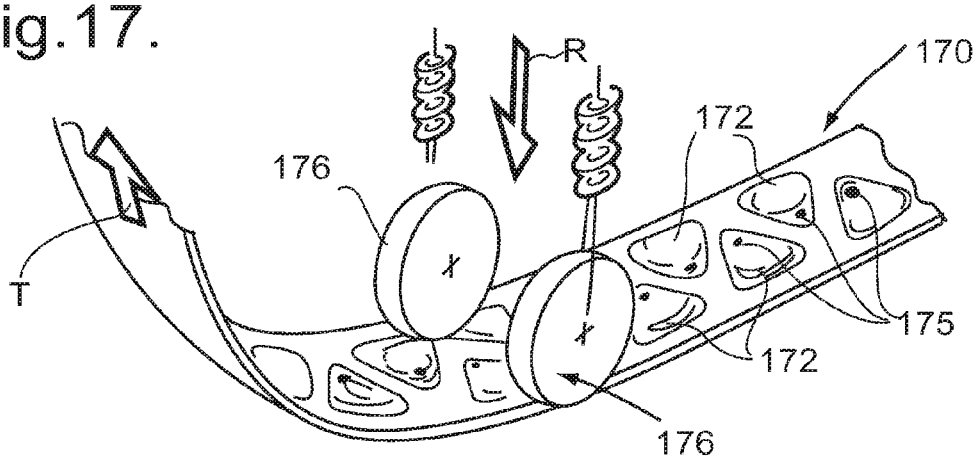
Figure 18:
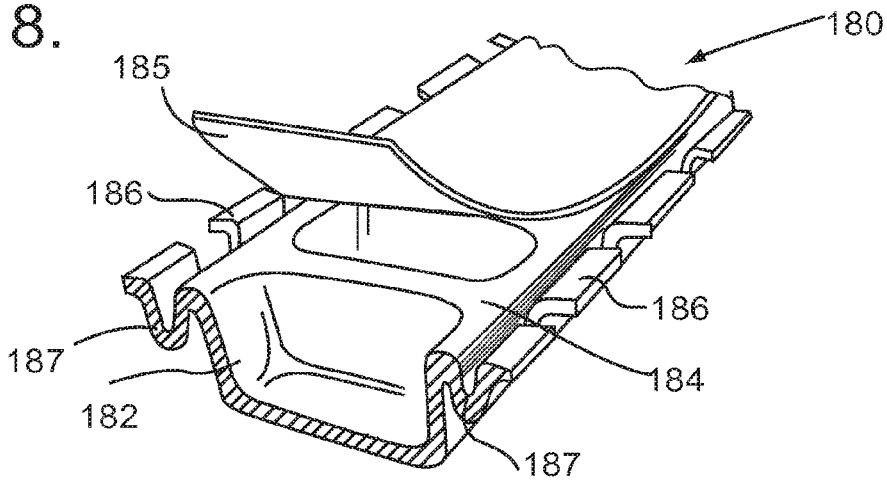
Figure 19:
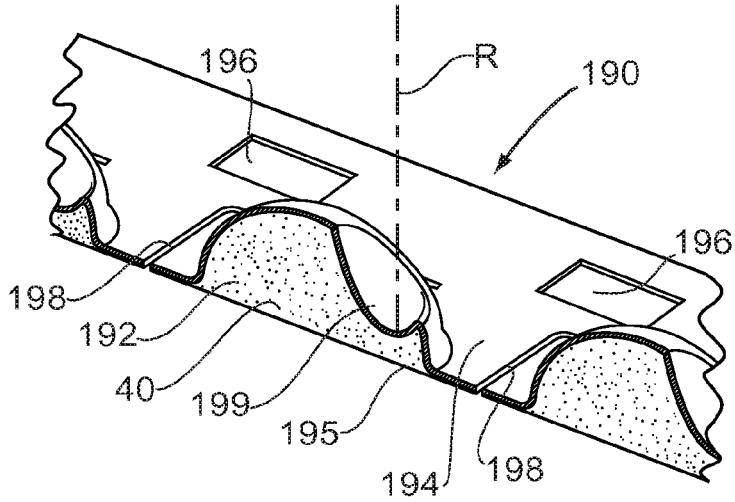
Figure 20:
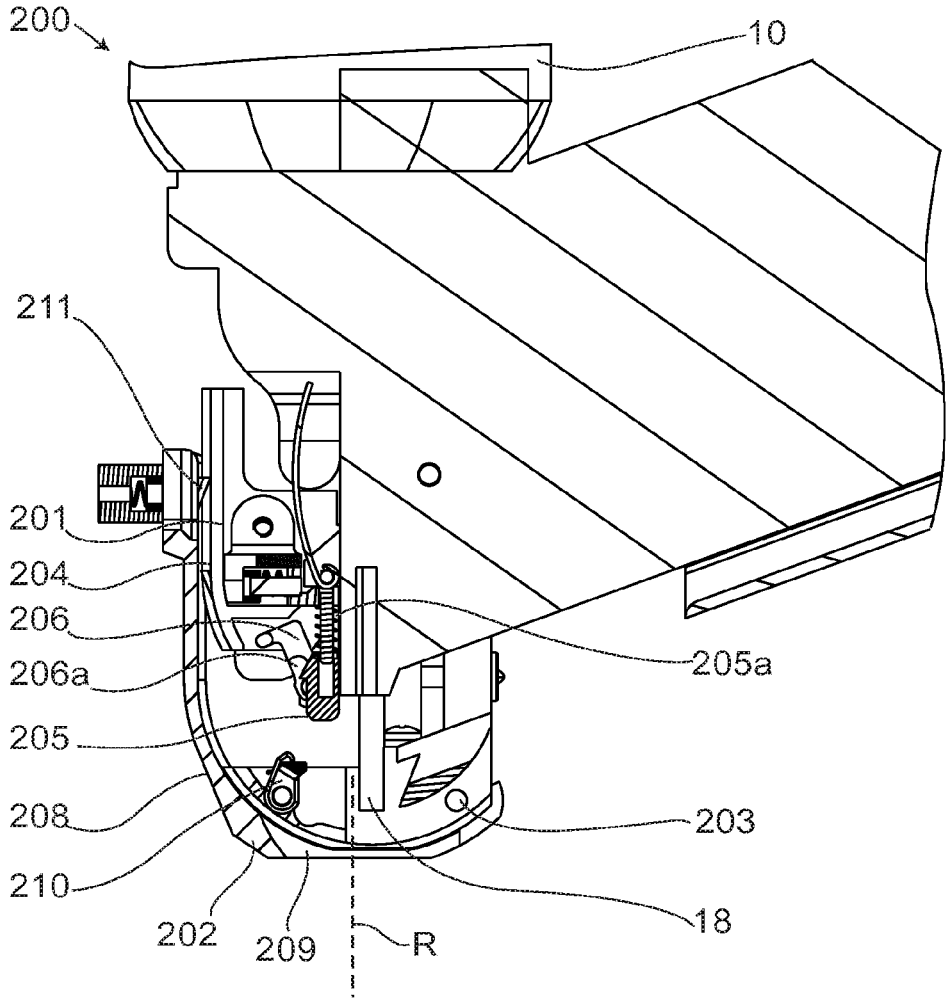
Figure 25:
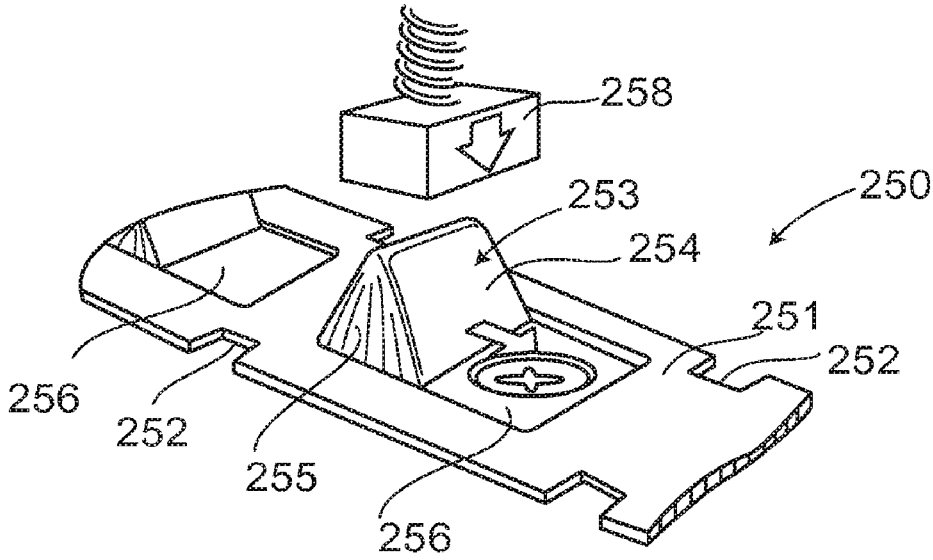
Figure 26A:
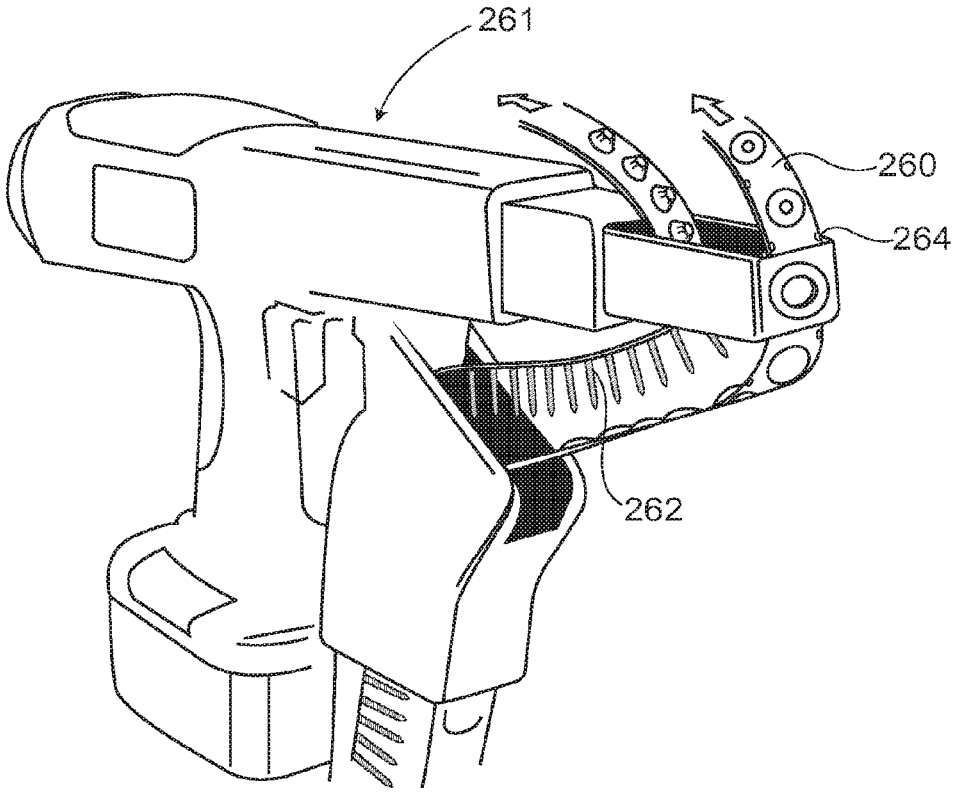
Figure 26B:
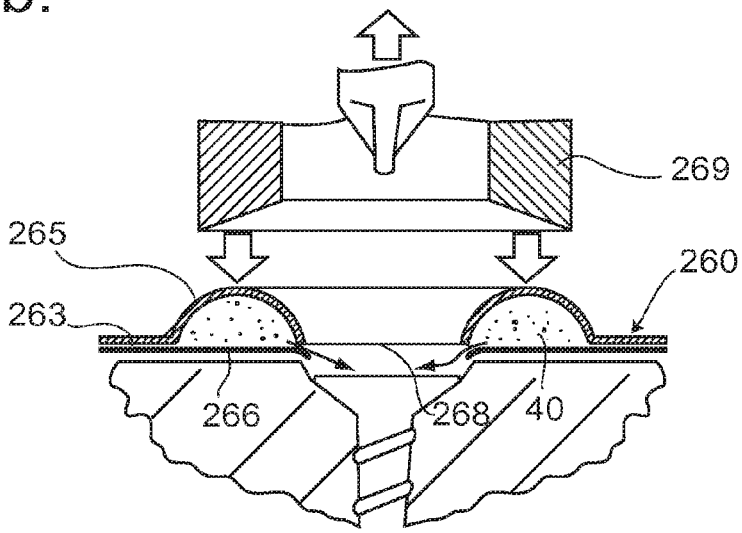
Figure 27:
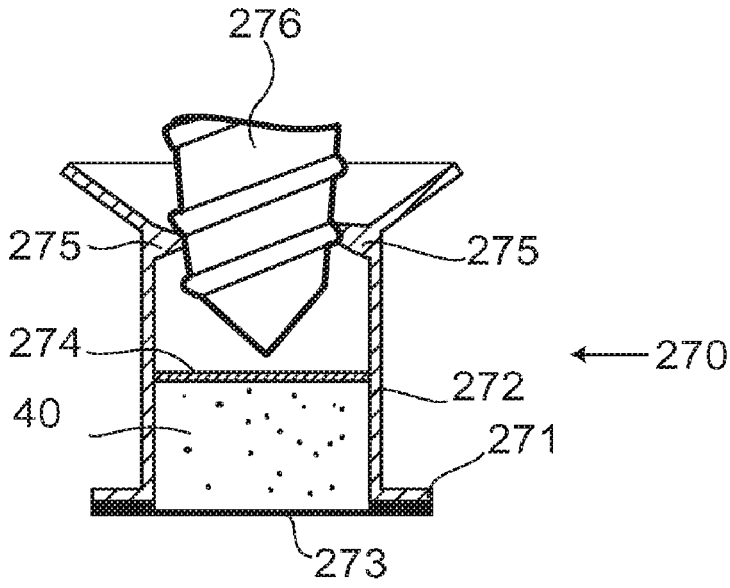
Figure 28:
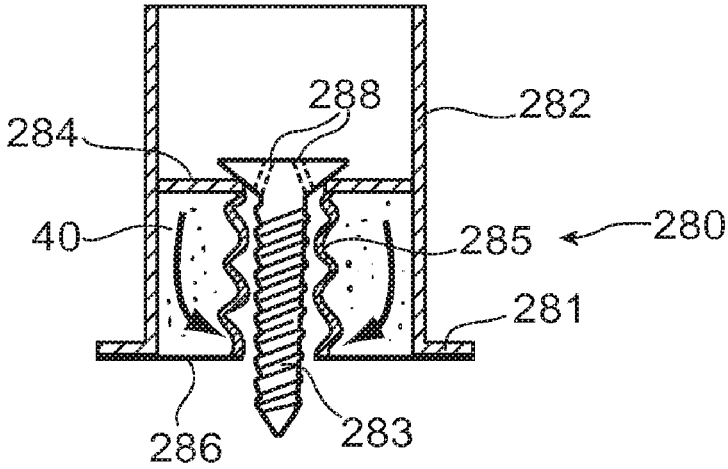

FIG. 16 shows a perspective view of an alternative dispensing strip for use with a mechanism as shown in FIG. 15;

FIG. 17 shows a perspective view of another alternative dispensing strip, along with part of an associated compression mechanism;

FIG. 18 shows a perspective view of another alternative dispensing strip, for use with a compression mechanism;

FIG. 19 shows a perspective view of an alternative dispensing strip, the strip being also shown in longitudinal section;

FIG. 20 shows a sectional view of a mechanism suitable for use with the dispensing strip of FIG. 19;

FIGS. 21, 22, 23 and 24 show sectional views of four other alternative dispensing strips;

FIG. 25 shows a perspective view of an alternative dispensing strip;

FIG. 26*a* shows a perspective view of a screw gun;

FIG. 26*b* shows a transverse sectional view of a dispensing strip for use in the screw gun of FIG. 26*a*; and FIGS. 27 and 28 show transverse sectional views of alternative dispensing strips for use with a screw gun.

Figure 1:
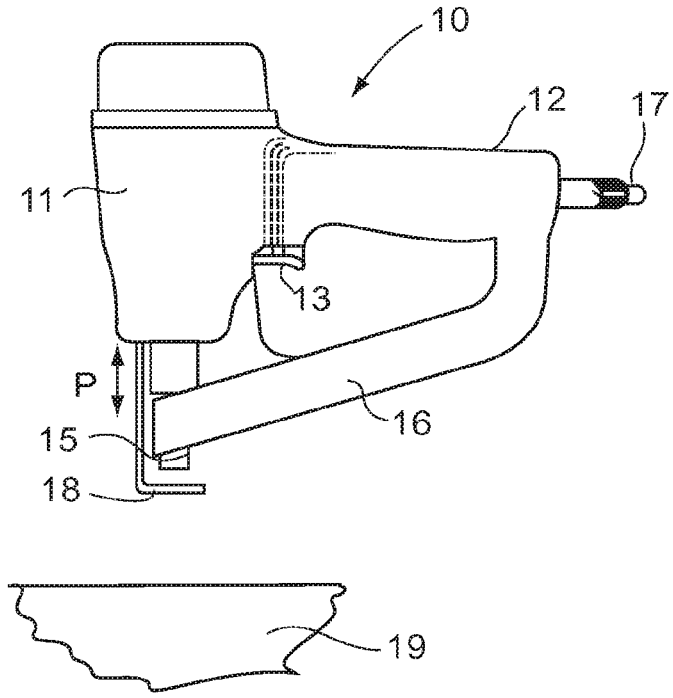
FIG. 1 shows a diagrammatic side view of a conventional nail gun.

As shown in FIG. 1, a conventional nail gun 10—whose component parts are represented somewhat diagrammatically, for clarity—comprises an operating unit 11 from which extends a hand grip 12 for an operator on which is a trigger 13. A nail guide 15 extends from the operating unit 11 downwardly (as shown). The nails to be fired from the gun 10 are held in a magazine 16 extending between the outer end of the hand grip 12 and the nail guide 15. In use the nails from the magazine 16 are fed one at a time into the nail guide 15. The nail gun 10 in this example is operated by compressed air supplied through a compressed air line 17 connected to the hand grip 12. A resiliently mounted safety foot 18 in the form of a thick wire loop with a central aperture extends to just beyond the end of the nail guide 15.

In use the nail gun 10 is held by the operator and pushed so that the end of the nail guide 15 comes into contact with a surface of a workpiece 19 into which the nails are to be driven, pushing up the safety foot 18 so that the end of the nail guide 15 enters the aperture of the safety foot 18. The operator then pulls the trigger 13, and a nail is fired down the nail guide 15 into the workpiece 19. Another nail is then fed into the nail guide 15 from the magazine 16 for use at another position on the workpiece 19. As a safety feature, the operating unit 11 will not fire a nail unless both the safety foot 18 is pushed in (so that the end of the nail guide 15 is up against the workpiece 19), and also the trigger 13 is squeezed by the operator. The movement of the safety foot 18, as indicated by the double arrow P, is parallel to the nail guide 15. The distance the safety foot 18 must be raised to permit operation of the nail gun 10 can be adjusted.

Figure 2:
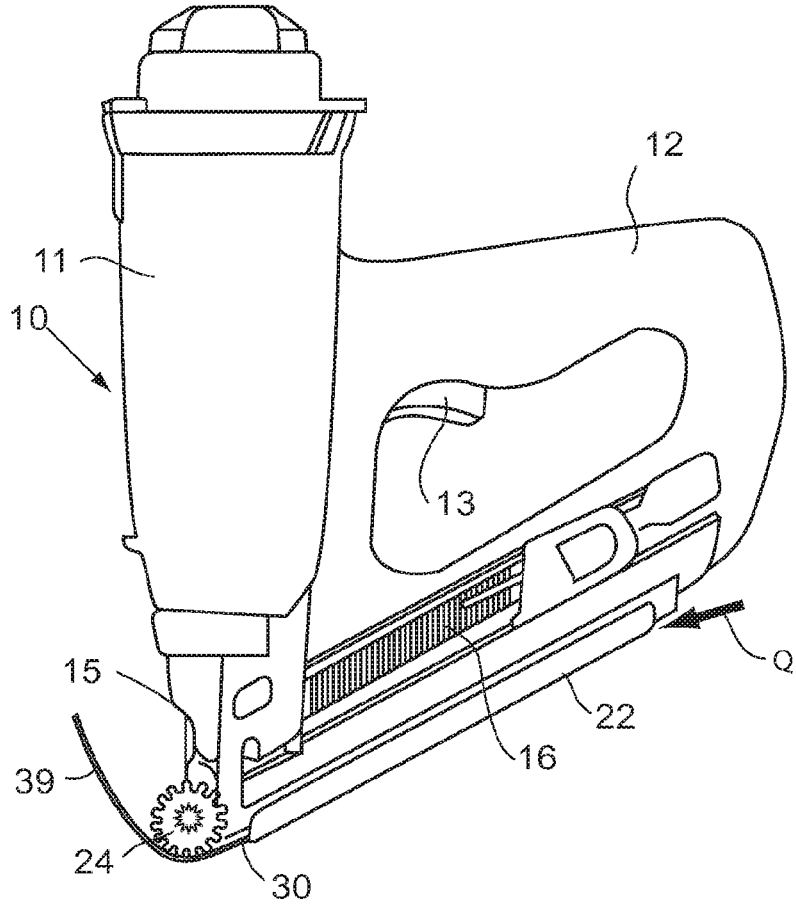
FIG. 2 shows a side view of a conventional nail gun incorporating a recess filling apparatus.

Referring now to FIG. 2 there is shown a nail gun 10 substantially equivalent to that shown in FIG. 1, the same components being indicated by the same reference numerals. In this case a strip support 22 is attached to the underside of the nail magazine 16, this strip support 22 defining a groove along its lower surface with two opposed flanges to support the edges of a dispensing strip 30 (see FIG. 3). As indicated by the arrow Q, a dispensing strip 30 can be inserted into the groove of the strip support 22 at the end remote from the nail guide 15. Toothed wheels 24 are mounted on each side of the nail guide 15 near the bottom, the upward movement P of the safety foot 18 (not shown in FIG. 2) causing a spring (not shown) to urge the wheels 24 to turn, but this turning movement being triggered by movement of the nails in the nail magazine 16. In some cases the dispensing strip 30 may be considerably longer than the length of the strip support 22, and a canister (not shown) may be provided on the nail gun 10 to support the additional length of dispensing strip 30 either as a concertina or as a roll. The strip support 22 may be aligned with the centreline of the hand grip 12, or may be inclined at an angle to that centreline.

It will be appreciated that a nail gun 10 as shown in FIG. 2 may be driven by a pneumatic system (as described in relation to FIG. 1), but that alternative drive means might include electrical power, or internal combustion (using a fuel such as butane). The means used to power the nail gun 10 are not an aspect of the present invention. The mechanism for advancing the dispensing strip 30 may differ from the wheels 24, and may be actuated by the same power source as that used for firing the nails, or may be actuated by another power source; or may be actuated mechanically by compression of the safety foot 18 by the operator. A variety of mechanisms are described below.

Figure 3:
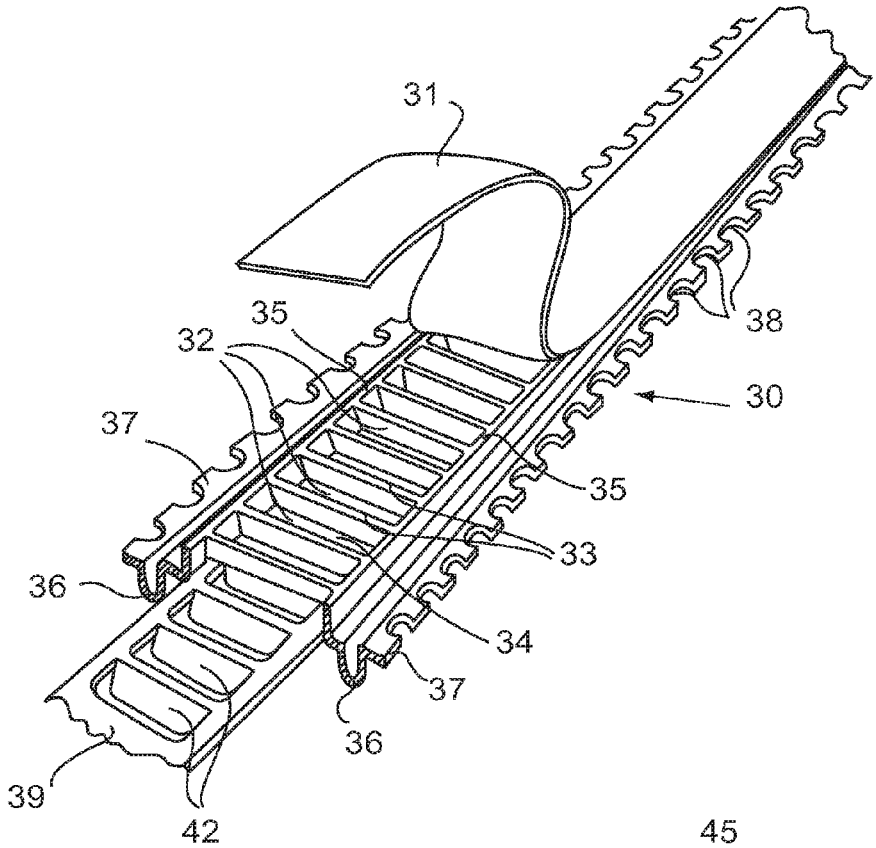
FIG. 3 shows a perspective view of a dispensing strip for use with the apparatus of FIG. 2.
Figure 4:
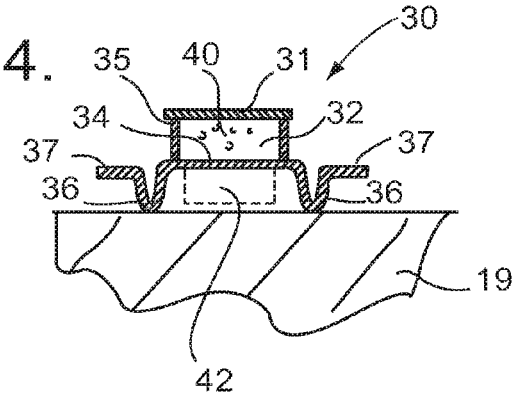
FIG. 4 shows a cross-sectional view of the dispensing strip of FIG. 3.

Referring to FIG. 3 there is shown a dispensing strip 30 for use with the apparatus of FIG. 2. The dispensing strip 30 defines a multiplicity of rectangular chambers 32 covered and sealed by a foil strip 31 (partly peeled away to show the chambers 32). Each chamber 32 is defined by cross walls 33 joined to a base strip 34; these are joined to side walls 35. The base strip 34 and the side walls 35 extend the entire length of the dispensing strip 30. The side walls 35 are integral with longitudinal ribs 36 and projecting flanges 37 which define notches 38 along their length. When installed in the apparatus of FIG. 2, the flanges 37 engage with the flanges of the strip support 22, so that the dispensing strip 30 can slide along the strip support 22. The lower end of the dispensing strip 30 passes through the loop of the safety foot 18, and the used portion 39 of the dispensing strip 30 projects in front of the nail gun 10, and may be collected on a roller (not shown). As shown in FIG. 4, when the dispensing strip 30 rests on a surface of a workpiece 19, the ribs 36 contact the surface so the base strip 34 is spaced above the workpiece 19 by the height of the ribs 36 (although the ribs 36 may be compressible and resilient). The toothed wheels 24 (see FIG. 2) engage with the notches 38 along the projecting flanges 37, so that compression P of the safety foot 18 followed by the firing of a nail moves the dispensing strip 30 forward by one chamber 32. Each chamber 32 is filled with a suitable filler material 40 (not shown in FIG. 3 for clarity). The quantity of filler material 40, and consequently the size of the chambers 32, depends upon the size of the nails and consequently of the depressions or recesses that are to be filled, but by way of example each chamber 32 might contain between 30 and 100 $mm^3$, for example 60 $mm^3$ of filler 40 (that is to say 0.06 $cm^3$).

Thus in use of the nail gun 10 with the features shown in FIG. 2, with the dispensing strip 30 installed in the strip support 22, the nail gun 10 is operated substantially as normal. The nail gun 10 is pushed against the workpiece 19 to raise the safety foot 18, and the trigger 13 is then squeezed by the operator. The nail gun 10 fires a nail through one of the compartments 32, the foil strip 31 and the base strip 34 not significantly retarding the nail. The nail is then embedded in the workpiece 19, leaving a depression; but filler 40 is carried along by the nail, and fills the depression. The nails in the magazine 16 move forward (so the next nail is in position for use), so triggering the toothed wheels 24 to turn, and so moving the dispensing strip 30 forward so the next compartment 32 is in the operating position.

Referring again to FIGS. 3 and 4, in this example the base strip 34 in each compartment 32 is moulded such that when impacted by the nail it breaks open around three sides and forms a hinge line on the fourth side. Consequently it opens as a flap 42. In FIG. 4 the open position of the flap 42 is shown by a broken line. As the dispensing strip 30 is moved forward (after passage of a nail), this flap 42 acts as a wiper to smooth the filler in the depression. Preferably the height of the ribs 36 is such that the flap 42 swings through to beyond the vertical, when impacted by the nail, to end up with its long edge resting on the surface of the workpiece 19; in this orientation the surface that had formerly been the upper surface of the base strip 34 now acts as the wiper surface, smoothing the filler in the depression.

It will be appreciated that this dispensing strip 30 is shown by way of example only. Various modifications can be made while remaining within the scope of the present invention. For example instead of the base strip 34 forming a flap 42, the base strip 34 may break open in the impacted compartment starting at its centre (possibly along weak lines forming an X), so that the resulting broken edges do not extend to near the surface of the workpiece 19; in this case a separate wiper (not shown) is preferably provided on the underside of the dispensing strip 30 between successive compartments 32. Such a separate wiper may extend between the support ribs 36, or may be attached only along its top edge to the underside of the base strip 34. It will be appreciated that the dispensing strip 30 (with the exception of the filler 40 and the foil strip 31) may be moulded from a plastic material as an integral moulding, and that where separate wipers are provided on the underside, these would preferably also be an integral part of the moulding. It will also be appreciated that the height of the support ribs 36 may be proportionately less than shown here, for example the support ribs 36 might be of less height than the compartment 32, for example the ribs 36 might be of height 1 mm while the compartment 32 might be of height 3 mm. In yet another modification there may be no gap below the base of the compartments 32.

Figure 5:
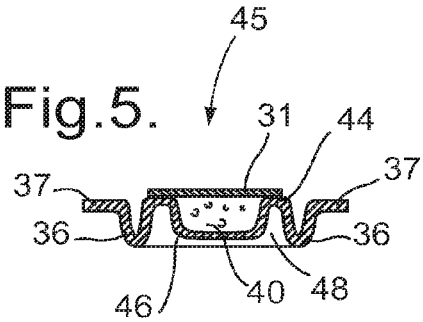
FIG. 5 shows a cross-sectional view of a modification to the dispensing strip of FIG. 3.

In the strip 30 the compartments 32 are above the level of the flanges 37; as shown in FIG. 5 in a modified dispensing strip 45 there are no cross walls 33 or side walls 35, and instead the ribs 36 are integral with a strip 44, and a multiplicity of compartments 46 are defined by recesses moulded to project below the strip 44. The ribs 36 in this example support the compartments 46 to leave a small gap (e.g. <1.5 mm) below them. Between successive compartments 46 are wiper blades 48 that extend across the strip 45 between the ribs 36. The compartments 46 contain filler material 40 and are sealed by a cover film 31.

Figure 6:
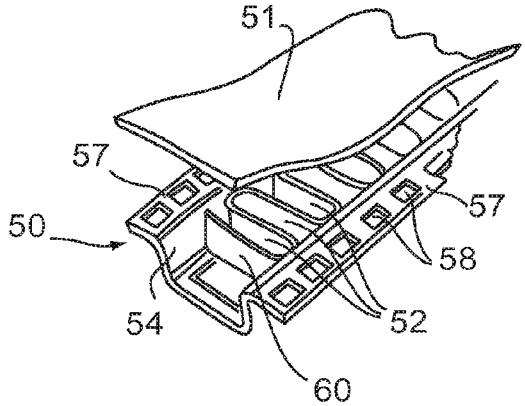
FIG. 6 shows a perspective view of an alternative to the dispensing strip of FIG. 3.

In an alternative, the compartments are defined at least in part by card or paper, which may be coated or treated to ensure the filler material does not set while in the compartments. For example, referring now to FIG. 6, a dispensing strip 50 comprises a multiplicity of chambers 52 covered by a flexible film 51. The chambers 52 are defined by a base card 54 bent to define a trough with side flanges 57. An array of apertures 58 extends along each flange 57. The trough is subdivided into the chambers 52 by a long narrow strip of card 60 which follows a sinuous or corrugated path across the width of the trough. This may be used in substantially the same way as the dispensing strip 30 of FIGS. 3 and 4, except that the strip 50 rests directly on the surface of the workpiece 19. A benefit of the use of card for this purpose is that the used strip projecting from the front of the nail gun 10 may be easily torn off.

In another modification means are provided to squeeze the foil strip 31 covering a compartment, as the nail is fired through that compartment 32, so that the filler material 40 is slightly pressurised.

Figure 7:
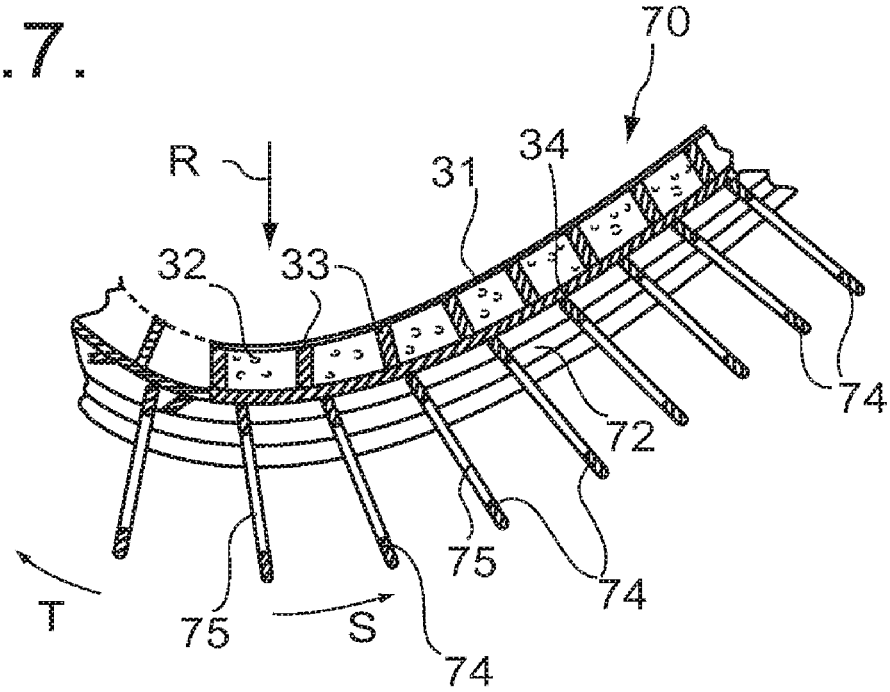
FIG. 7 shows a longitudinal sectional view of another modification to the dispensing strip of FIG. 3.

Referring now to FIG. 7 there is shown a dispensing strip 70 in longitudinal section incorporating various modifications to the strip 30 of FIG. 3, identical components being referred to by the same reference numerals. The dispensing strip 70 incorporates support ribs 72 that are of generally concertina-like form so they are readily compressible and resilient, initially 6 mm high but compressible down to 2 mm in this example, and the nail gun 10 is arranged that the safety plunger 18 allows a nail to be fired only when the support ribs 72 are compressed to this extent. The dispensing strip 70 is shown in the position it occupies when in the nail gun 10, the arrow R showing where the nail is fired, but the features of the nail gun 10 are not shown. Below each compartment 32 is a rectangular wiper 74 fixed to the base strip 34 at the front edge of the compartment 32, and projecting below. Each wiper 74 is in the form of a frame defining a rectangular aperture 75 of length 12 mm; and each wiper 74 initially projects at such an angle that the wiper 74 of the compartment 32 below arrow R is slightly behind the vertical. The used compartments 32 of the dispensing strip 70 follow a curved path, and so the wiper 74 of the adjacent used compartment is inclined just forward of the vertical.

Hence in use of the dispensing strip 70 the operator pushes the gun 10 down so as to compress the support ribs 72 in the vicinity of the compartment 32 under the arrow R, and in so doing the wipers 74 of some of the compartments come into contact with the surface of the workpiece. The wipers 74 of the unused compartments are bent backwards (arrow S), whereas the wipers 74 of the used compartments are bent forwards (arrow T). When the nail gun 10 is fired the nail passes through the rectangular aperture 75, and the nail gun 10 is then lifted off the surface (this may arise from the recoil after firing), and the resilience of the wipers 74 makes them spring back to their original position. The wiper 74 of the compartment 32 under the arrow R consequently wipes across the surface over the depression formed by the nail.

Figure 8:
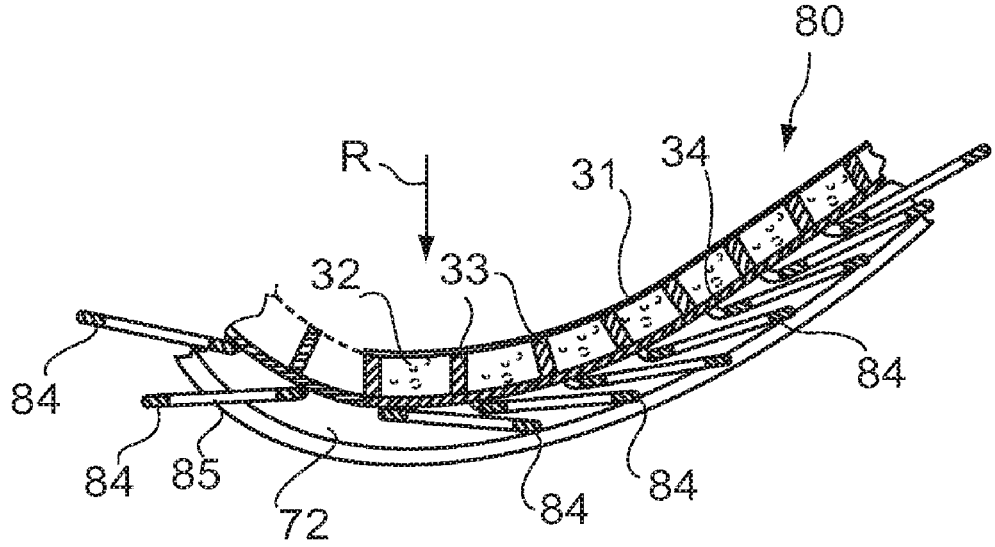
FIG. 8 shows a longitudinal sectional view of a modification to the dispensing strip of FIG. 7.

In yet another alternative modification shown in FIG. 8, to which reference is now made, a dispensing strip 80 again incorporates support ribs 72 that are of generally concertina-like form so that they are readily compressible and resilient. Integral with the base strip 34 near the front edge of each compartment 32 is a wiper 84 in the form of a frame defining a rectangular aperture 85 of length 10 mm. The unstressed orientation of each wiper 84 is inclined in the forwards direction, as shown for the used compartments 32, but the wipers of the unused compartments 32 are secured by respective breakable strips (not shown) so as to be inclined in the backwards direction. The breakable strip of the compartment 32 under the arrow R is broken either when the nail gun 10 is pushed down onto the surface by a mechanism linked to the safety foot 18, or is broken by the passage of the nail itself. The wiper 84 of that compartment 32 is therefore released, and when the nail gun 10 is lifted off the surface the wiper 84 springs back to the unstressed position, wiping across the surface over the depression formed by the nail.

It should be understood that the present invention encompasses both a nail gun 10 provided with the additional features illustrated in FIG. 2, and also to a kit (consisting of these additional features) for installing onto a conventional nail gun 10 as shown in FIG. 1. The additional features of these aspects of the present invention are the means to support the dispensing strip (the strip support 22), and the means for locating and advancing the dispensing strip (the wheels 24). It will also be appreciated that alternative means may be used to support the dispensing strip; and that alternative means may be used for locating the dispensing strip, and that alternative means may be used for advancing the dispensing strip. The means for advancing the dispensing strip may be powered manually (as described above), by the operator pushing the nail gun 10 towards the surface, but alternatively it may be powered electrically or pneumatically, such alternatives being particularly suitable if the nail gun itself is powered in this way. In the case described above the advancing of the dispensing strip 30 is triggered mechanically by the movement of the nails in the magazine 16, but the advancing may also be initiated in response to an electrical or pneumatic signal.

Referring now to FIG. 9, an alternative mechanism 90 for advancing a dispensing strip 91 is shown. The nail gun 10 is not shown, for clarity. The dispensing strip 91 passes along a generally horizontal path below the nail gun, the chain broken line R indicating the line along which the nail will be fired, and passes around a wheel 88 which includes a ratchet mechanism 92 to prevent the strip 91 going backwards. A cam 93 is supported on a pivot; it is spring-loaded into the position shown in FIG. 9*a*, and defines a through-hole 94 and two projections 95 and 96. The wheel 88 and the cam 93 are both supported on the safety foot 18 of the nail gun 10. In the initial position, shown in FIG. 9*a*, the rear projection 96 engages the rear side of an unused filler compartment. When the gun 10 is depressed, a block 97 on the gun pushes the cam 93 around into the position shown in FIG. 9*b*, so that the nail can be fired through the through-hole 94 and through the previously-unused filler compartment. As the gun is lifted away from the surface, the block 97 allows the cam 93 to rotate back, as indicated by the arrow Q. In the position shown in FIG. 9*c*, the forward projection 95 squeezes the used cell to help push out the filler, and then as the cam 93 returns to the initial position shown in FIG. 9*a* the rear projection 96 engages the next unused compartment and moves it forward into the operating position, as indicated by the arrow T.

Referring now to FIG. 10, an alternative mechanism 100 for advancing a dispensing strip 91 is shown. The nail gun 10 is not shown, for clarity. The dispensing strip 91 passes along a generally horizontal path below the nail gun, the chain broken line R indicating the line along which the nail will be fired, and passes guide wheels 101 (or a smooth rounded locating profile in the underneath of the mechanism shroud that drives the cell strip forwards) before and after passing the firing position R, and then passes over a wheel 88, these wheels 101 and 88 all being in fixed positions relative to the safety foot 18. A spring clip 104 connected to the gun 10 engages with notches on the dispensing strip 91 just below the wheel 88 in the initial position shown in FIG. 10*a*. As the gun is depressed, this clip 104 comes out of engagement with the notches and slides down along the dispensing strip 91 into the position shown in FIG. 10*b* in which the clip 104 engages with another set of notches on the dispensing strip 91. The gun is fired. Then as the gun is raised away from the surface, the spring clip 104 pulls the dispensing strip 91 into the next firing position.

Referring now to FIG. 11, an alternative mechanism 110 for advancing a dispensing strip 91 is shown. The nail gun 10 is not shown, for clarity. The dispensing strip 91 passes along a generally horizontal path below the nail gun, the chain broken line R indicating the line along which the nail will be fired, and passes around wheels 112 before and after passing the firing position R, and then passes over guide wheels 113. The wheels 112 engage with notches in the dispensing strip 91, so they hold the strip firmly and in tension. The wheels have toothed portions at one end which engage a toothed gear wheel 114, so they can only rotate together. The wheels 112 and 114 are all supported on the safety foot 18. As the gun is depressed, a protruding bar 116 engages with a ratchet-like set of teeth 118 on the toothed gear wheel 114, so rotating the wheels 112 and moving the dispensing strip 91 forward by a fixed amount.

Referring now to FIG. 12, an alternative mechanism 120 is shown for advancing a dispensing strip 91. The dispensing strip 91 passes along a generally horizontal path below the nail gun, passing around guide wheels 122 before and after the firing position R. It then passes around a drive wheel 124 which has a series of cam-shaped teeth around its circumference, and which is secured by a ratchet mechanism (not shown) against rotation in the backward direction. These components are supported on the safety foot 18. The nail gun 10 carries a pivoted cam 126 shown in its rest position, and spring-loaded into this position. As the gun is depressed, the cam 126 bumps against the circumference of the drive wheel 124, and then returns to its rest position when below the drive wheel 124, so it engages with one of the cam-shaped teeth. After the gun has been fired, it is lifted away from the surface, and the cam 126 turns the drive wheel 124 and so moves the dispensing strip 91 forward.

It should be appreciated that a nail gun may include more than one strip advancing mechanism. For example it may include the mechanism 90 and also the mechanism 100.

In some cases it may be advantageous to actively squeeze filler material out of a compartment after firing the nail. This may be achieved using a roller (not shown) which is moved across the used compartment after firing, and the movement of the roller may be initiated by lifting the gun off the surface.

Alternatively, as shown in FIG. 13 to which reference is now made, a mechanism 130 for this purpose comprises a plunger 132 with a horizontal lower face, which slides to and fro along an inclined guide, driven by a connecting rod 133 whose opposite end is connected eccentrically to a toothed wheel 134. These components are supported on the safety foot 18. The toothed wheel 134 is spring-loaded into the position with the plunger 132 closest to the surface. The nail gun 10 carries a toothed rod 136 whose length is equal to half the circumference of the wheel 134.

In use, the gun is pushed down against the surface, and the toothed rod 136 rotates the wheel 134 through half a revolution, moving the plunger 132 away from the surface and ensuring that it is clear of the nail-firing axis R. After the nail has been fired, as the gun is lifted away from the surface, the plunger 132 is driven forward and impacts with the used compartment, so pushing the filler into the recess above the nail head.

An alternative dispensing strip 140 is shown in FIGS. 14*a* and 14*b*, to which reference is now made. In this case the strip 140 defines a multiplicity of approximately rectangular chambers 142 moulded to project above a base strip 144, whose underside is covered and sealed by a foil strip 145 after the chambers 142 have been filled with filler material 40. The edges of the base strip 144 provide flanges for supporting the dispensing strip 140, and define notches 146. The chambers 142 are spaced apart, and the sections of the base strip 144 between successive chambers 142 are moulded to define a stiffening rib 147, and are cut along three sides of a rectangle to define a wiper blade 148 (this cut extending through the foil strip 145 too).

Referring now to FIG. 15, the dispensing strip 140 passes around a pair of spaced-apart rollers 150, and the nail-firing line R (as shown by the arrow) passes between these rollers 150. After the nail has been fired, the dispensing strip 140 is moved forward (in the direction of the arrow T) by the distance corresponding to the space between successive chambers 142 (or successive notches 146), and as the strip 140 passes around the rollers 150 the wiper blade 148 immediately behind the used chamber 142 sticks out, and clears any excess filler material 40 off the surface, this excess filler material 152 being trapped on the other surface of the wiper blade 148. Thus in this case the leading edge of the wiper blade removes any excess filler material 40.

It should be appreciated that the dispensing strip 140 may be modified in various ways. For example as shown in FIG. 16, to which reference is now made, a dispensing strip 160 defines a multiplicity of approximately rectangular chambers 162 moulded to project above a base strip 164, whose underside is covered and sealed by a foil strip 165. The edges of the base strip 164 provide flanges for supporting the dispensing strip 160, and define notches 166. Around each chamber 162 the base strip 164 is cut along three sides of a rectangle to define a wiper blade 168 (this cut extending through the foil strip 165 too), leaving a clearance between the edge of the chamber 162 and the cut. As indicated schematically, after the nail has been fired the dispensing strip 160 is moved forward (arrow T) around rollers (as described in relation to FIG. 15) and the front edge of the next (unused) chamber 162 clears any excess filler 152 off the surface. The dispensing strip 160 is shown in the position after it has finished moving forward, so the next (unused) chamber 162 is now aligned with the nail firing axis R.

As described in relation to FIG. 13, means may be provided for squeezing filler onto the surface after firing the nail. Alternatively (or additionally) a dispensing strip may be arranged such that the compartment through which the nail is fired is already under compression. For example, as shown in FIG. 17, a dispensing strip 170 may define compartments 172 that project above a base strip 174. In this example the compartments 172 are (in plan view) triangular with the base of the triangle parallel to the edge of the strip, and the positions 175 (marked by dots) at which the nail is fired through each compartment 172 being near the opposite apex (along the centreline of the dispensing strip 170). In the position where the dispensing strip 170 passes the nail firing axis R there are spring-loaded rollers 176 bearing down on the outer edges of the strip 170, and so compressing the base part of the compartment 172.

Alternatively, referring to FIG. 18, a dispensing strip 180 defines a multiplicity of compartments 182 projecting below a base strip 184, and covered with a foil seal strip 185. The compartments 182 have walls that are sufficiently thin to be readily collapsible; the edges of the base strip 184 define notched flanges 186 and a U-shaped trough 187 which extends about half the depth of the compartments 182. In use rollers (not shown), similar to the rollers 176 shown schematically in FIG. 17, are arranged either side of the nail firing axis R, and locate in the troughs 187. These rollers compress the compartment 182, so that the filler material is already under compression when the nail is fired.

Referring now to FIG. 19 there is shown a dispensing strip 190 defining compartments 192 and intended for use with a nail gun 10 provided with a spring-loaded plunger 205 (shown in FIG. 20) similar to that described in relation to FIG. 13, but arranged to impact on a compartment 192 after firing of a nail but before the nail gun 10 is retracted far from the surface of the workplace.

In this case the compartments 192 project above a base strip 194, being moulded from thin plastic material, and a foil strip 195 bonded to the underside for example with a heat activated glue (as used in medical pill cell packaging) seals the underside of the compartments 192 after they have been filled with filler material 40. The edges of the base strip 194 provide flanges for supporting the dispensing strip 190, and define notches 196. Around each compartment 192 the base strip 194 is cut along three sides of a rectangle to define a wiper blade 198 (this cut extending through the foil strip 195 too), leaving a clearance between the edge of the compartment 192 and the cut. In use the strip 190 is located into and pulled around a curved recessed track in the support mechanism, and after a nail has been fired through a compartment 192 the strip 190 is moved forwards, curving away from the workpiece, and the wiper blade 198 of the next (unused) compartment 192 is automatically deployed, applying pressure with its leading edge pushing and wiping into contact with the filler material at the surface of the workpiece around the previous fired nail hole and leaving a smooth surface. This wiping action also collects and removes any filler material left on the workpiece to be retained away from the workpiece and gun, for subsequent disposal along with the spent strip 190.

The compartments 192 are of a rounded capsule shape, longer than they are wide, being symmetrical on either side of the centreline on which the sectional view is shown, but defining a dimple 199 near the rear end of the compartment 192. In this case the line R along which the nail is fired passes through the centre of this dimple 199. The plunger 205 (shown in FIG. 20) is arranged to impact on the front end of the compartment 192 after firing of a nail but before the nail gun 10 is retracted far from the surface. In this case the plunger may be arranged to follow a path perpendicular to the surface of the workpiece. After the nail has been fired the compartment 192 is pierced both in the top plastic surface and the bottom foil 195, and when the plunger 205 is activated most of the filler material 40 is squeezed out of the bottom of the compartment 192, but a portion is squeezed upwards. One purpose of this dimple 199 is to act as a collector for the surplus upwards-squeezing filler material.

Referring now to FIG. 20, this shows a sectional view of a mechanism 200 attached to a nail gun 10, a first part 201 being attached to the front face of the nail gun 10 and a second part 202 being attached to the safety foot 18 and pivotally connected to it at a pivot 203. The first part 201 includes spring-loaded ratchet teeth 204 to engage the notches 196 on the strip 190; the spring-loaded plunger 205 and a spring **205*a*; and a pivoted release trigger 206 defining a cam surface 206*a*. The second part 202 defines a casing 208 to guide and support the strip 190 around a curved path, with an aperture 209 at its base in the vicinity of the nail-firing line R; inside the casing 208 is a spring-loaded catch 210; and spring-loaded ratchet teeth 211 are mounted at the top of the casing 208**.

In use, one end of the dispensing strip 190 is fed manually through the casing 208, so the ratchet teeth 204 and 211 engage with the notches 196. As the safety foot 18 is compressed, the ratchet teeth 204 come out of engagement, slide down the dispensing strip 190, and come into engagement with the next notches 196; after firing, as the safety foot 18 moves down again, the ratchet teeth 204 hold the strip 190, so advancing it around the curved path, while the ratchet teeth 211 come out of engagement and slide down into engagement with the next notches 196.

As the safety foot 18 is compressed a projection on the plunger 205 engages with the catch 210, so further compression of the safety foot 18 compresses the spring **205*a*. The cam surface 206*a* then comes down to below the catch 210. After firing, as the gun 10 moves away from the workpiece the cam surface 206*a* acts against the catch 210 to release the plunger 205 and so fire the plunger 205 into the compartment 192 to squeeze the filler material 40** out onto the workpiece.

Although the mechanism 200 has been described as being used with the dispensing strip 190, it may also be used with dispensing strips of different designs. For example it may be used with the dispensing strips 140 or 160.

Figure 21:
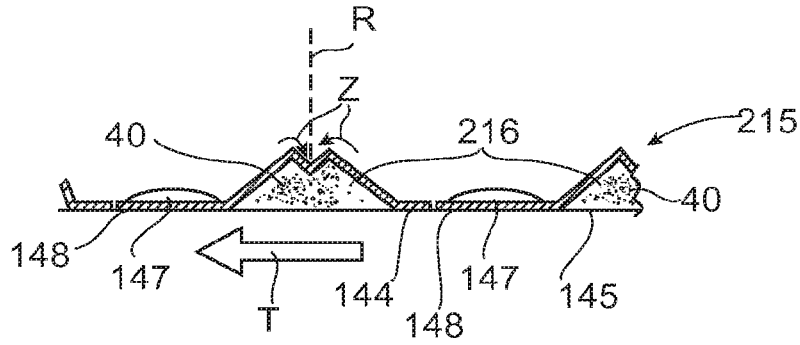

It will be appreciated that the several different shapes of dispensing strip and of filler-containing compartment were described above by way of example only, and that the compartments may differ from those described above. If the filler material has adhesive properties, a benefit of firing the nail through the filler material is that the joint formed by the nail can be of increased strength. It will also be appreciated that the filler material may be of substantially the same colour as the surface in which the recess has been formed, so the filled recesses are not prominent. Alternatively the filler material may be of a different colour, and in particular it may be of a prominent and distinctive colour so that the positions of the nails (and the use of the filler material) are clearly visible. The filler material may also comprise anti-slump agents, or anti-rust agents, and the filler material may be rapid setting (as compared to conventional filler material), as the apparatus of the invention leaves a smoothed surface.

Where a mechanism is provided to squeeze the filler material out of a compartment, this may comprise a plunger, for example as described in FIGS. 13 and 20, or rollers as described in FIG. 17. As previously mentioned, rollers might be arranged to move across the compartment so the roller movement is substantially transverse to the firing line R. The plunger may alternatively include rollers. Rather than impacting on the same portion of the compartment as that through which the nail has passed (as in FIG. 13), or in front of the firing line R (as in FIG. 20), the plunger might instead impact on the compartment to one side or the other of the firing line R or behind the firing line R, or indeed the plunger might partially or completely surround the firing line R.

Where a mechanism is provided to squeeze the filler material out of a compartment it may also be desirable to provide a compartment shape that suppresses leakage of filler material through the hole caused by the passage of the fixing element through the top of the compartment. Referring now to FIG. 21 there is shown a dispensing strip 215 similar to that of FIG. 14*b* (similar elements being referred to by the same references) defining compartments defined in a plastic strip moulded to project above a base strip 144 whose underside is sealed by a foil strip 145; sections of the base between successive compartments define a stiffening rib 147 for a wiper blade 148. In this example the compartments 216 are M-shaped in longitudinal section and the firing line R is aligned with the centre of the M. Immediately after firing of the nail a plunger compresses the compartment 216 (for example as described in relation to FIG. 20), tending to squeeze the opposed halves of the M together as indicated by the arrows Z and so inhibiting flow of filler material 40 through the hole in the top created by the nail.

The recess filling apparatuses described above were primarily described for use with a nail gun, and so with fixing elements whose head is not much larger than the shank. Where the fixing elements have a head significantly larger than the shank, for example with large-headed nails or screws, it may be necessary to use compartments of a slightly different shape to ensure that the fixing element passes right through the dispensing strip without the head catching on the plastic and so fixing the dispensing strip itself onto the workpiece. It may also be necessary to use a dispensing strip with larger compartments, as the resulting depressions may be larger.

Figure 22:
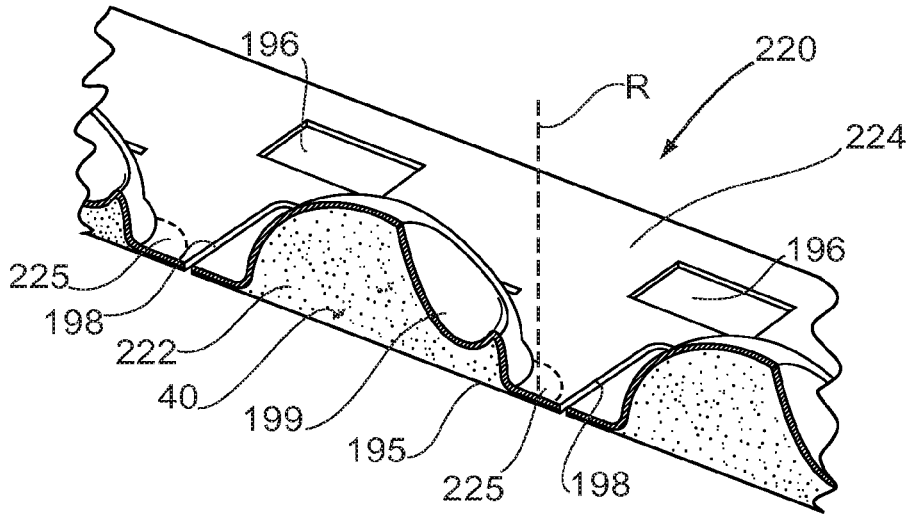

For example a strip 140 as described in relation to FIGS. 14*a* and 14*b* might be modified by defining an aperture over most of the top of the compartment 142, this aperture being covered by a thin foil. This would be used in the same way as described above, but the fixing element, whether a large-headed nail or a screw, would only have to pass through the two thin foil layers at top and bottom of the compartment 142. As another alternative a strip 140 might be modified by moulding lines of weakness into the plastic forming the top of the compartment 142, so that on impact from the fixing element the top breaks open along those lines to allow ready passage of the fixing element. For example there might be lines radiating out from the point aligned with the firing line R, or a circular line centred on that point. The same modifications might be made to other dispensing strips, for example to the dispensing strips 160 or 190.

Where the mechanism includes means to compress the compartment after the fixing element has been fired, and so to squeeze out the filler material 40, as in the mechanisms 130 and 200, it is not essential that the firing line R passes through the filler material, as long as passage of the fixing element opens up an aperture through which the filler material can be squeezed out into the resulting recess. For example a dispensing strip 220 is shown in FIG. 22, this being a modification to the dispensing strip 190 of FIG. 19 and the same reference numerals are used for the same features. In this case the compartments 222 are rounded, with no dimple, and formed from a plastic base strip 224. The foil 195 is adhered to the underside of the base strip 224 apart from a semi-elliptical region 225 that extends from the rear edge of the compartment 222, the boundary of this un-adhered region 225 being shown by a broken line. In this case the firing line R passes through this region 225. On passage of the fixing element and compression of the compartment 222 the material 40 would be squeezed out at least partly into the recess above the fixing element.

Where the fixing element has a head that is of larger diameter than its shank, the dispensing strip 220 is also suitable, but in this case the point of impact would preferably be surrounded by a pre-scored circular line of weakness on the base strip 224, arranged to break when impacted by the head of the fixing element.

The dispensing strip of the invention may also be used with an apparatus for filling recesses, for example recesses produced by driving a fixing element into a workpiece. This apparatus could be used after nails have been driven in with a nail gun. The apparatus incorporates a guide to support the dispensing strip, means to dispense filler from a compartment, and a mechanism to advance the dispensing strip so the next compartment can be used. Preferably each compartment is associated with a wiper, and this may operate as the dispensing strip advances, so the filler in the recess is left with a smoothed surface. In this case it is necessary to make a hole in the underside of each compartment that contains filler material 40, and this may be done in substantially the same way as described above but using a captive metal spike impacting on the compartment so as to puncture holes in both the top and bottom, or using a very high pressure air blast to achieve such holes; the compartment can then be compressed for example by a plunger or by rollers as described above.

Figure 23:
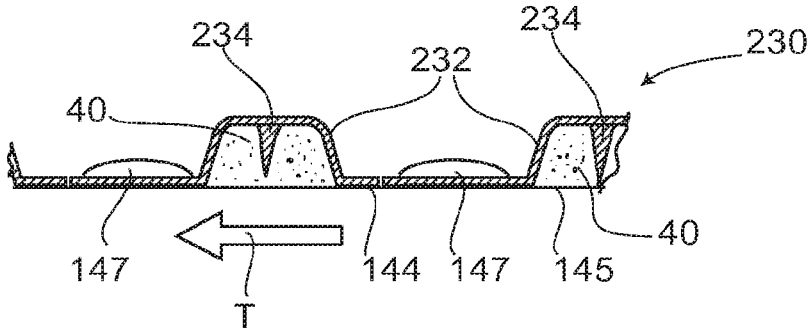

As an alternative, where the compartments are defined by a moulded plastic sheet whose underside is covered with thin foil, the inside top surface of each compartment may define a projecting spike terminating a short distance above the foil. For example as shown in FIG. 23 there is shown a dispensing strip 230 similar to that of FIG. 14*b* (similar elements being referred to by the same references) with compartments 232 defined in a plastic strip moulded to project above a base strip 144 whose underside is sealed by a foil strip 145; sections of the base strip 144 between successive compartments define a stiffening rib 147 for a wiper blade 148. In this example each compartment 232 defines such a spike 234. To dispense the filler material 40 the compartment 232 would be compressed from above so the spike 234 forms a hole in the foil 145; that downward compression may then be released and pressure applied from a different direction so that filler material 40 is squeezed out of the hole. In other respects operation of the recess-filling apparatus is as described above. Equivalent modifications could for example be made to the dispensing strips of FIGS. 16, 17 and 19.

Figure 24:
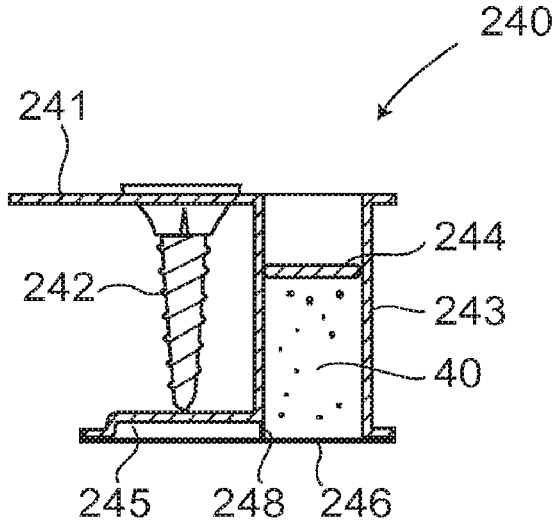

As described in relation to FIG. 22 the fixing elements may be screws, with a head that is larger than the shank. Referring now to FIG. 24 a dispensing strip 240 is shown that carries both screws and compartments for filler material. A long strip 241 of plastics material has notches (not shown) along its sides for location, and screws 242 are located through cross-shaped slots equally spaced along the length of the strip 241. Moulded integrally onto the side of the strip 241 adjacent to the location of each screw 242 is a cylindrical chamber 243 whose longitudinal axis is perpendicular to the plane of the strip 241, so it extends alongside the screw 242. Within each chamber 243 is a thin web 244; and a shallow chamber 245 of similar cross-section projects sideways from the bottom end of the chamber 243 so its top wall abuts the bottom of the screw 242. A foil 246 covers the bottom of the cylindrical chamber 243 and also the bottom of the shallow chamber 245 (which together form a generally rectangular shape with rounded ends). The cylindrical chamber 243 between the web 244 and the foil 246 is filled with filler material 40.

The shallow chamber 243 may communicate freely with the cylindrical chamber 243 and also be full of filler material 40; or (as shown) the wall 248 separating the shallow chamber 245 from the cylindrical chamber 243 may be sufficiently thin that it bursts when the piston 244 is moved down to pressurise the filler material 40. The upper wall of the shallow chamber 243 may define a thin circular region that breaks away from the remainder of the strip 240 and is left behind on the workpiece, or a thin cross shape that breaks open, so that the screw or nail head can pass through the upper wall of the shallow chamber 245 without securing the strip 240 to the workpiece.

In use, the strip 240 is introduced into a screw gun (not shown). When a screw 242 is screwed into a workpiece, it passes through the top wall of the shallow chamber 245 and the foil 246 underneath. A plunger (not shown) is then activated to push the web 244 down, acting as a piston, and the filler material 40 bursts through into the shallow chamber 245 and so fills the recess above the screw head. The leading edge of the bottom of the chambers 243 and 245 may be provided with a wiper blade (not shown).

Alternatively the screw or the head of the fixing element might pierce the edge of a thin protruding element communicating with the cylindrical chamber 243.

Referring now to FIG. 25 a filler dispensing strip 250 is shown for use in conjunction with a separate strip of collated screws (not shown) in a screw gun. The strip 250 comprises a plastic base strip 251 defining notches 252 along its sides for location purposes, with compartments 253 moulded above the base strip 251 in the form of two oppositely-inclined plane surfaces 254 linked by comparatively thin triangular side faces 255. The underside of the base strip 251 is sealed onto a foil strip, so defining the under surface of the compartments 253. Each compartment is filled with filler material 40 (not shown in FIG. 25). Adjacent to each compartment 253 is a rectangular aperture 256 through both the base strip 251 and the foil.

In use, the strip 250 is introduced into a screw gun, and the notches 252 are used align it so that when a screw is screwed into a workpiece it passes through the rectangular aperture 256 immediately adjacent to the next unused compartment 253. A plunger 258 (represented diagrammatically) is then arranged to push down on the top of the compartment 253 so that the triangular side faces 255 tear or stretch, the edge of the surface 254 moves across the aperture 256, and so the filler material is introduced into the recess above the screw head. This may be in two stages: compression by the plunger 258 may be started while the screw is being screwed in, so that the initially-dispensed filler material contacts the thread of the screw; further compression occurs to fill the recess. On withdrawal of the plunger 258 the compartment 253 may be sufficiently resilient that the edge of the surface 254 springs back across the filler material in the recess. The plunger 258 may be activated by a mechanism analogous to that described above in relation to FIG. 20 and triggered in response to movement of the screw gun away from the surface, or alternatively may be activated by a mechanism associated with the screw drive mechanism.

Referring now to FIGS. 26*a* and 26*b* an alternative filler strip 260 is used in conjunction with a screw gun 261 in conjunction with a separate strip 262 of collated screws. The strip 260 comprises a plastic base strip 263 defining locating notches 264 along its sides, with annular compartments 265 moulded above the base strip 263. The underside of the base strip 263 is sealed onto a foil strip 266, so defining the under surface of the compartments 265. Each compartment 265 is filled with filler material 40. There is a circular aperture 268 in the centre of each compartment 265, through the base strip 263 and optionally also through the foil strip 266.

In use the strip 260 is introduced into the screw gun 261, and the notches 264 are used align it so that when a screw is screwed into a workpiece it passes through the circular aperture 268 at the centre of the next unused compartment 265. An annular plunger 269 is then arranged to push down on the compartment 265 so that the foil strip 266 tears away from the base strip 263 around the edge of the aperture 268, allowing filler material 40 to be dispensed. This may be started while the screw is being screwed in, so that the initially-dispensed filler material 40 contacts the thread of the screw; further compression occurs to fill the recess.

The base strip 263 may be shaped into a lengthwise zigzag or V-shape between successive compartments 265, so that the dispensing strip 260 can readily be stretched without any detrimental effect on the compartments 265. This may be desirable depending on the mechanism that feeds the collated screw strip 262 through the screw gun 261, as in some cases the dispensing strip 260 may be stretched longitudinally.

Referring now to FIG. 27, an alternative dispensing strip 270 supports the screws at their points rather than their heads. This simplifies aligning the screws with the compartments. The dispensing strip 270 consists of a base strip 271 defining locating notches along its sides, and defining open-ended cylindrical chambers 272 projecting above the base strip 271. The underside of the base strip 271 is sealed by a foil strip 273. At an intermediate position within each chamber 272 is a web 274, the enclosed space between the web 274 and the foil 273 being filled with filler material 40. The top of the chamber 272 is open and is splayed outwardly into a funnel shape; around the top of the cylindrical part are four spaced-apart inwardly-projecting bumps 275. A screw 276 is secured by engagement between the bumps 275 and the thread of the screw 276 near its point.

In use the dispensing strip 270 is fed through a screw gun. As screws 276 are driven in to a workpiece they burst through the thin web 274 and the foil 273, so the thread is coated in filler material 40. The head of the screw 276 splits the chamber 272 in two as it passes through. The strip 270 may be provided with a wiper (not shown) to smooth the excess filler into the recess above the screw head. In a modification, the dispensing strip 270 is also provided with compartments alongside the screws like those described in relation to FIG. 24, and a separate plunger used to dispense filler material from this compartment into the recess.

Referring now to FIG. 28 there is shown an alternative dispensing strip 280. In this case there is a base strip 281 from which open-ended cylindrical chambers 282 extend upwardly, these being of large enough diameter that a screw 283 can pass through them. At an intermediate position within the chamber 282 is a web 284, joined to the wall of the chamber 282 by a thin peripheral portion, and with a central circular hole below which extends a concentric thin-walled tube 285. The annular chamber defined between the thin-walled tube 285 and the surrounding portion of the cylindrical chamber 282 is filled with filler material 40, and the lower face is sealed by a thin metal foil 286.

In use, as a screw 283 is inserted through the tube 285 and into a workpiece, the head of the screw 283 pushes down on the web 284, breaking it free from the wall of the chamber 282 so it acts as a piston and pushes down on the filler material 40. The thin-walled tube 285 is compressed, and the filler material 40 bursts through the seal between the foil 286 and the bottom of the thin-walled tube 285 so as to coat the thread of the screw 283.

It will be appreciated that in both the dispensing strip 270 and the dispensing strip 280 it may be desirable to use screws whose heads are provided either with peripheral notches or with through-holes (shown in broken lines as 288), so that filler material 40 from below the head can pass around or through the head to fill the recess above the head. In both cases there may be a risk that filler material comes into contact with the blade of the screwdriver; to avoid contamination of the blade it may be retracted after each use into a sleeve so that any further material on the sides is wiped off.

It will be appreciated that the dispensing strips and mechanisms described above are by way of example only. In particular it should be appreciated that dispensing strips may incorporate features that are described in relation to separate designs of dispensing strip above.

We claim:

1. A recess filling apparatus suitable for filling recesses produced by driving a fixing element into a workpiece, the apparatus being suitable for use with a dispensing strip defining a multiplicity of chambers containing filler material, each chamber containing sufficient filler material for use with a single such recess, and the apparatus comprising means to support the dispensing strip, and means for locating a chamber that contains filler material adjacent to such a recess and for dispensing at least part of the filler material in the chamber into the recess, and then for advancing the dispensing strip prior to filling the next recess.

2. A recess filling apparatus as claimed in claim 1 suitable for use with the dispensing strip that defines a wiper element associated with each chamber, and wherein the apparatus moves the wiper element over the surface of the filler material by advancing the dispensing strip.

3. A dispensing strip suitable for use with a recess filling apparatus as claimed in claim 1, the dispensing strip defining a multiplicity of chambers containing filler material, and the dispensing strip defining engagement means to enable the chambers to be located in a position for use, and to be advanced prior to using the next chamber, and each chamber containing sufficient filler material for use with a single recess.

4. A dispensing strip as claimed in claim 3 comprising support projections such that, in use, a gap is defined between the base of each chamber and the workpiece.

5. A dispensing strip as claimed in claim 4 wherein the support projections are continuous ribs.

6. A dispensing strip as claimed in claim 3 wherein the dispensing strip also defines a wiper element associated with each chamber, arranged so that after filler material has been introduced into a recess the advancing of the dispensing strip moves wiper element over the surface of the filler material.

7. A dispensing strip as claimed in claim 6 wherein each wiper element is inclined to the surface so as to moves over the surface with its trailing edge in contact with the surface.

8. A dispensing strip as claimed in claim 6 wherein each wiper element is inclined to the surface of the workpiece so as to move over the surface with its leading edge in contact with the surface.

9. A dispensing strip as claimed in claim 8 wherein each wiper element is formed by part of a base strip of the dispensing strip.

* * * * *